US005592209A

United States Patent [19]

Hasegawa et al.

[11] Patent Number: 5,592,209

[45] Date of Patent: Jan. 7, 1997

[54] DEVICE AND METHOD FOR DOT-MATRIX THERMAL RECORDING

[75] Inventors: Takanori Hasegawa; Koichi Okusawa, both of Tokyo-to, Japan

[73] Assignee: Riso Kagaku Corporation, Tokyo-to, Japan

[21] Appl. No.: 400,967

[22] Filed: Mar. 8, 1995

Related U.S. Application Data

[63] Continuation-in-part of Ser. No. 218,706, Mar. 28, 1994.

[30] Foreign Application Priority Data

Feb. 21, 1991 [JP] Japan ..... 3-027517

[51] Int. Cl.[6] ..... B41J 2/335

[52] U.S. Cl. ..... 347/206

[58] Field of Search ..... 101/128.4; 347/206, 347/171

[56] References Cited

U.S. PATENT DOCUMENTS 5,216,951 6/1993 Yokoyama et al. ..... 347/206

FOREIGN PATENT DOCUMENTS 2-067133 3/1990 Japan ..... 347/206

*Primary Examiner*—Huan H. Tran

*Attorney, Agent, or Firm*—Dickstein Shapiro Morin & Oshinsky LLP

[57] ABSTRACT

Provided is a device which can form favorable perforated images corresponding to the resolution of the thermal head, reproduce faithful printed images for all kinds of original picture images, avoid ink transfer, and adapt itself to different environmental conditions, and is suitable for use with different thermal recording materials such as thermal recording paper, OHP TP sheets, and thermal stencil master plates. In the device of the present invention, a thermal head 4 consisting of a plurality of heat emitting elements 5 arranged in a single row in the primary scanning direction is directly contacted to the recording surface of a thermal recording material such as thermal recording paper, and the thermal recording material 1 is moved relative to the thermal head 4 in the secondary scanning direction which is perpendicular to the direction of the row of the heat emitting elements so that picture images may be formed with a dot matrix by selectively heating the thermal heat emitting elements at an appropriate timing in relation to the movement of the thermal recording material in the secondary scanning direction, the ratios of the length of each heat emitting element 5 in the primary and secondary scanning directions to the pitches of the primary and secondary scanning are set 30 to 70% and 60 to 95%, respectively.

23 Claims, 8 Drawing Sheets

DEVICE AND METHOD FOR DOT-MATRIX THERMAL RECORDING

CROSS-REFERENCE TO RELATED APPLICATIONS

This is a continuation-in-part application of U.S. patent application Ser. No. 08/218,706 filed Mar. 28, 1994 which is now abandoned.

TECHNICAL FIELD

The present invention relates to a thermal recording device for forming an image with a dot matrix by applying a thermal head to a heat-sensitive recording material such as heat-sensitive printing paper, thermal transfer ribbon, and to thermal stencil master plates made by laminating a thermoplastic film over a porous support.

BACKGROUND OF THE INVENTION

The thermal recording device which forms images with a dot matrix by using a thermal head is conventionally known, and such a thermal recording device forms images by applying a thermal head consisting of a plurality of heat emitting elements onto thermal recording paper, an OHP coloring TP sheet, an OHP frosted TP sheet, recording paper in conjunction with the use of thermal transfer ribbon, or a recording surface of heat sensitive recording material such as a thermal stencil master plate, and by selectively heating the heat emitting elements. Such thermal recording devices are widely used as facsimiles, printers for ticket dispensers, hand-held copiers, OHP transparency making devices, and thermal master plate making devices.

In facsimiles, the feed speed of the thermal recording paper in the longitudinal direction or in the secondary scanning direction is determined by a unified standard, and the size of each heat emitting element is determined according to the feed speed in the secondary scanning direction. Further, the aspect ratio of each heat emitting element is determined to be a/b=½ by a communication standard where a and b are the lengths of each heat emitting element in the primary and secondary scanning directions, respectively, the primary direction corresponding to the lateral direction of the paper or the direction of the row of the heat emitting elements.

Therefore, in the high resolution mode (fine mode) of the facsimile standard in which Pa=Pb where the dot pitch in the primary scanning direction is Pa and the dot pitch in the secondary scanning direction is Pb, b>Pa=Pb holds, and there will be some overlapping in the heat emitting regions of the heat emitting elements for each small distance along the secondary scanning direction.

If a thermal stencil master plate is processed or made by forming stencil images on a thermo-plastic film of a thermal stencil master plate with a thermal head for a facsimile of the above described kind in a mode equivalent to the high resolution mode of the facsimile standard, continuous openings will be formed in the thermo-plastic film of the thermal stencil master plate along the secondary scanning direction due to the above-mentioned overlapping. This causes not only the thickening and blurring of the lines of printed character and line images but also excessive deposition of ink onto the printing paper in solid areas of the picture images which could in turn cause conspicuous smearing of the reverse surface of the printing paper by ink transfer in continuous printing.

To overcome this problem, it has been proposed to make a thermal stencil master plate with a thermal head using heat emitting elements each of which is shorter in length along the secondary scanning direction than the pitch of the secondary scanning, and to ensure formation of unaffected parts between the perforations along the secondary scanning direction as disclosed in Japanese patent laid open publication No. 2-67133.

According to this proposal, since the perforations formed in the thermoplastic resin film of the thermal stencil master plate are formed so as to be independent from each other in both primary and secondary scanning directions, it is possible to faithfully reproduce character images by printing, and to control excessive deposition of ink and reduce ink transfer from one sheet to another.

However, images formed by perforation of a film of a thermal stencil master plate are inferior in quality as compared to those formed by using thermal coloring type media, such as thermal recording paper, in terms of reproducibility (resolution) as compared to the original images, in particular the evenness of fine lines and small characters, legibility of small outlined characters, the sharpness of fine black and white patterns such as halftone screen images, and digitally reproduced photographic gradations.

Further, in a high temperature environment, the perforation of the thermo-plastic resin film of the thermal stencil master plate, due to melting, tends to be excessive, and, combined with the lowering of the viscosity of the ink, the thickening and blurring of lines of character images become more pronounced, as compared to the original images, than in a normal or low temperature environment. Additionally, the smearing or the ink transfer of the printing paper tends to be more pronounced due to increase in the amount of ink deposition, and the acceptable temperature range becomes narrower.

Thus, it has not heretofore been possible to provide a thermal recording device which can achieve the picture quality equivalent or comparable to those of the picture images produced by the coloring of thermal recording paper in the picture images produced by using the thermal stencil master plate, and achieving a desired uniformity in picture quality even when thermal recording materials having different recording properties are used.

BRIEF SUMMARY OF THE INVENTION

In view of such problems of the prior art, a primary object of the present invention is to eliminate such problems and to provide a thermal stencil master plate making device which can form favorable stencil images for a given resolution of the thermal head, reproduce faithful printed images for all kinds of original picture images, prevent ink transfer, and adapt itself to various environmental conditions.

A second object of the present invention is to provide a thermal recording device which is suitable for use with a wide range of thermal recording materials having different recording properties, such as thermal recording paper, OHP TP sheets, and thermal stencil master plates.

These and other objects of the present invention can be accomplished by providing a thermal recording device for forming an image with a dot matrix, comprising: a thermal recording material; a thermal head, including a plurality of heat emitting elements arranged in a single row at a first pitch along a primary scanning direction; thermal head applying means for applying the thermal head onto a surface of the thermal recording material; thermal recording material moving means for moving the thermal recording material relative to the thermal head in a secondary scanning direction perpendicular to the primary scanning direction; and heating means for selectively heating the heat emitting element in synchronism with a movement of the thermal recording material in the secondary scanning direction, wherein, a ratio of a first length of each of the heat emitting elements of the thermal head in the primary scanning direction to the first pitch is 30 to 70%, and a ratio of a second length of each of the heat emitting elements of the thermal head in the secondary scanning direction to the second pitch is 60 to 95%, and wherein, a dot matrix pitch of an image formed on the thermal recording material in the primary scanning direction is determined by the first pitch of the heat emitting elements and in the secondary scanning direction by a heat emitting timing of the heat emitting elements relative to a movement of the thermal recording material in the secondary scanning direction.

The present invention also provides a method for forming a dot matrix image on a thermal recording material comprising the steps of: applying a thermal head onto a surface of the thermal recording material; moving the thermal recording material relative to the thermal head in a secondary scanning direction; and selectively heating a plurality of heat emitting elements of the thermal head along a primary scanning direction by heating the heat emitting elements at an appropriate timing in relation to a movement of the thermal recording material in the secondary scanning direction; wherein, ratio of a first length of each of the heat emitting elements of the thermal head in the primary scanning direction to the first pitch is 30 to 70%, and a ratio of a second length of each of the heat emitting elements of the thermal head in the secondary scanning direction to the second pitch is 60 to 95%, and wherein, a dot matrix pitch of an image formed on the thermal recording material in the primary scanning direction is determined by the first pitch of the heat emitting elements and in the secondary scanning direction by a heat emitting timing of the heat emitting elements relative to a movement of the thermal recording material in the secondary scanning direction. The dot matrix pitch of an image formed on the thermal recording material in the secondary scanning direction may also be determined by controlling heat emission of the heat emitting elements relative to a movement of the thermal recording material in the secondary scanning direction, or, alternatively, the dot matrix pitch of an image formed on the thermal recording material in the secondary scanning direction may also be determined according to a heat emitting response property of the heat emitting elements relative to a moving speed of the thermal recording material in the secondary scanning direction.

In the thermal recording device of the present invention, since the size of each of the heat emitting elements of the thermal head is determined such that:

length in the primary scanning direction

→30 to 70% of the pitch of the primary scanning length in the secondary scanning direction →60 to 95% of the pitch of the secondary scanning not only each of the dots selectively formed in the thermo-plastic resin film is independent from others, but also the quality of the picture images which may be evaluated in terms of the evenness of fine lines and small characters, legibility of small outlined characters, the sharpness of fine black and white patterns such as halftone screen images, and digitally reproduced photographic gradations, which has been considered to be inferior to that of the images formed on thermal recording paper, can be improved to a comparable level.

The primary reason which makes the quality of the picture images formed by thermal stencil master plate printing less favorable to that by thermal recording paper printing is found in the fact that the shape of the perforated dots in the film of the thermal stencil master plate are not so uniform as the colored dots of the thermal recording paper and, even though they may form independent dots, for instance, when three consecutive heat emitting elements along the secondary scanning direction are heated at the same time to form an image by perforation, the heat emitting elements are affected by the adjacent ones and the behavior of the melting and shrinking of the part of the perforated thermo-plastic resin film which directly contacts the heat emitting elements depend on the way the film is supported by the porous support fibers. In particular, when there is no support fibers under the thermo-plastic resin film upon which the heat emitting elements are pressed, the melting and shrinking of the film tends to be excessive. If such an area not supported by fibers extends over a number of heat emitting elements and is heated by several of the heat emitting elements at the same time, the dots may excessively expand or clog adjacent ones by expansion with the result that the adjacent dots are affected and the sizes of the perforated dots become uneven.

Further, in the process of preparing a thermal stencil master plate in high temperature environment, the thermal effect from adjacent heat emitting elements becomes so pronounced that the thickening and blurring of fine lines tends to be significant, the quality of picture images become even more inferior to those of the thermal recording paper, and the excessive deposition of printing ink onto the printing paper through the expanded dots increases the possibility of ink transfer or the smearing of the reverse surface of the printing paper.

On the other hand, according to the thermal recording device of the present invention, since the length of each heat emitting element of the thermal head in the primary scanning direction is 30 to 70% of the pitch of the primary scanning and the length in the secondary scanning direction is 60 to 95% of the pitch of the secondary scanning to the end of avoiding the deterioration of the quality of the picture images due to the unevenness of the shape of the perforated dots, each of the dots would not be affected by the heating of the dots adjacent thereto along the primary scanning direction, and stable perforation may be achieved on the thermo-plastic resin film of the thermal stencil master plate so that the evenness of the perforated dots can be improved, and the quality of the printed images becomes comparable to that of the thermal recording paper. Further, in carrying out the process of plate making in high temperature environment, perforations may be formed in a stable fashion to an extent which has not heretofore been attainable, and the quality of picture images may be improved with the added advantage of eliminating ink transfer.

Since each of the perforated dots is independent from each other, and the shape of the dots is highly uniform, the part remaining between the perforated dots of the thermo-plastic resin film of the thermal stencil master plate is made uniform, and the strength of the film is improved so that the number of sheets of paper that can be printed with the same master plate may be increased.

The thermal recording device of the present invention offers a significant advantage over the method of making a recorded article with a number of steps such as the method involving the steps of processing a thermal stencil master plate and making printed materials, and the method of processing printing paper by using such thermal recording media as thermal transfer ribbon, and can be used in conjunction with the method of making recorded materials with a single step by using such materials as thermal recording paper and OHP coloring TP sheets. According to the thermal recording device of the present invention, the printed records (printed characters) are formed by independent dots, and the density of the printed characters (colored images) may become slightly less dark due to the reduction in the area of each printed (colored) dot. But, it is not significant, and the reproducibility and legibility of small characters and images actually improve.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
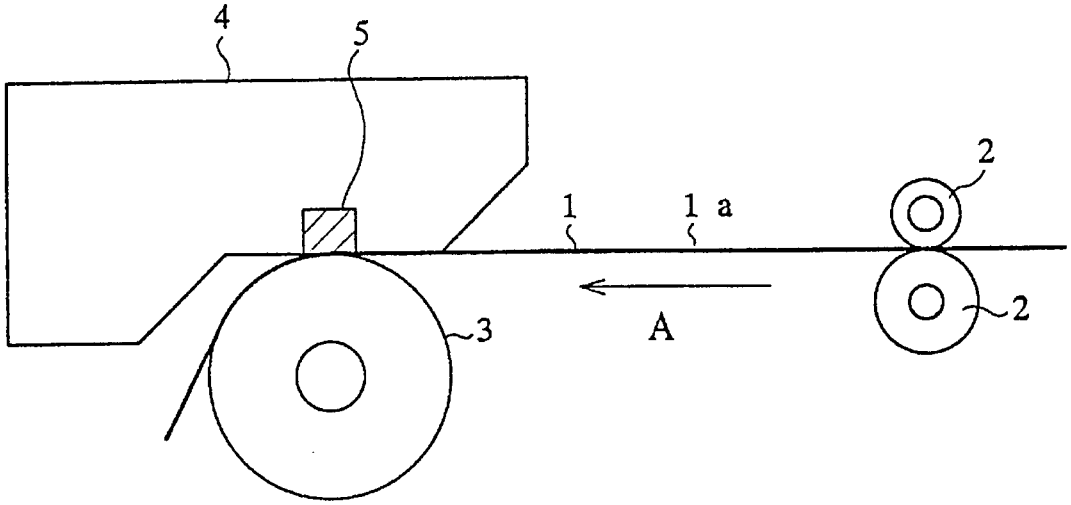
FIG. 1 is a schematic side view of an embodiment of the thermal recording device of the present invention.

FIG. 1 shows the general structure of an example of thermal recording device according to the present invention. In the illustrated thermal recording device, thermal recording material 1 is conveyed in the direction indicated by the arrow A (secondary scanning direction) by a platen roller 3 which is rotatively driven by a stepping motor described hereinafter. The platen roller 3 which may consist of a resilient material such as rubber or other polymer material applies the thermal recording material 1 against a thermal head 4. Then, heat emitting elements 5 provided in the thermal head 4 are placed in direct contact with a recording surface (surface 1*a* in the drawing) of the thermal recording material 1, and recorded images are formed on the recording surface 1*a* of the recording material 1 by selectively heating the heat emitting elements 5.

Thus, the heat emitting elements 5 of the thermal head 4 are brought into direct contact with the recording surface 1*a* of the thermal recording material 1, and are selectively heated to form a single line of an image while the thermal recording material 1 is conveyed by a distance corresponding to a single line of the image by the rotation of the platen roller 3. Optionally, the conveying rollers 2 may be rotatively driven by power means such as a stepping motor instead of driving the platen roller 3. In either case, the movement of the thermal recording material 1 may be carried out either in a continuous manner or in a step-wise manner.

The recording surface 1*a* of the thermal recording material 1 corresponds to the surface carrying the coloring layer of thermal printing paper or coloring type TP sheet, or the thermo-plastic resin film of a thermal stencil master plate, or the base film of thermal transfer ribbon.

Figure 2:
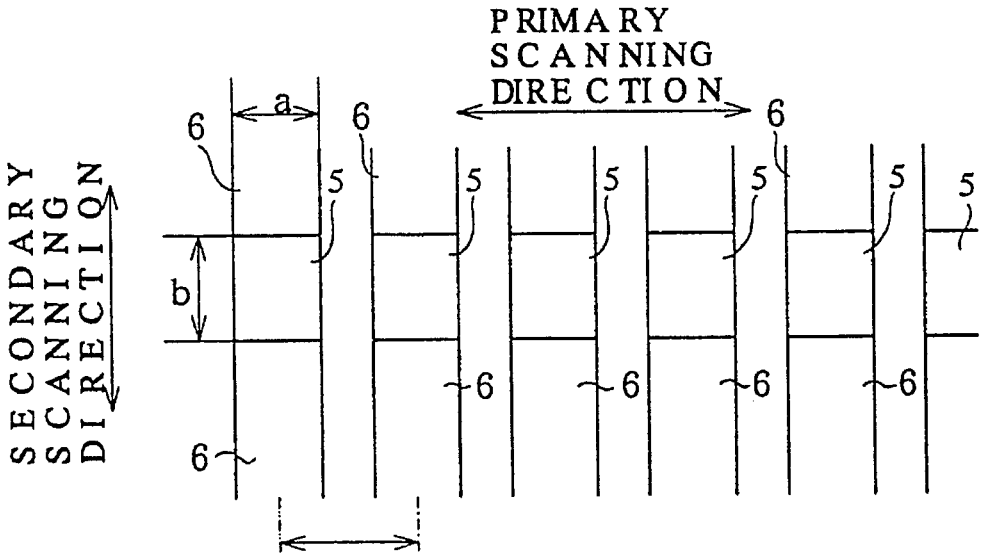
FIG. 2 is a schematic plan view of the thermal head used in the thermal recording device of the first embodiment.

FIG. 2 is a schematic plan view of the thermal head 4. As shown in this drawing, the heat emitting elements 5 of this thermal head 4, each having a rectangular shape, are arranged in a single row, at a pitch of Pa, along a primary scanning direction which is perpendicular to the secondary scanning direction given as a direction in which the thermal recording material 1 is conveyed or as the direction of the relative movement. The two ends along the secondary scanning direction of each of the heat emitting elements 5 are connected to electrodes 6, respectively, so that electric power may be supplied individually to each of the heat emitting elements 5.

Figure 9:
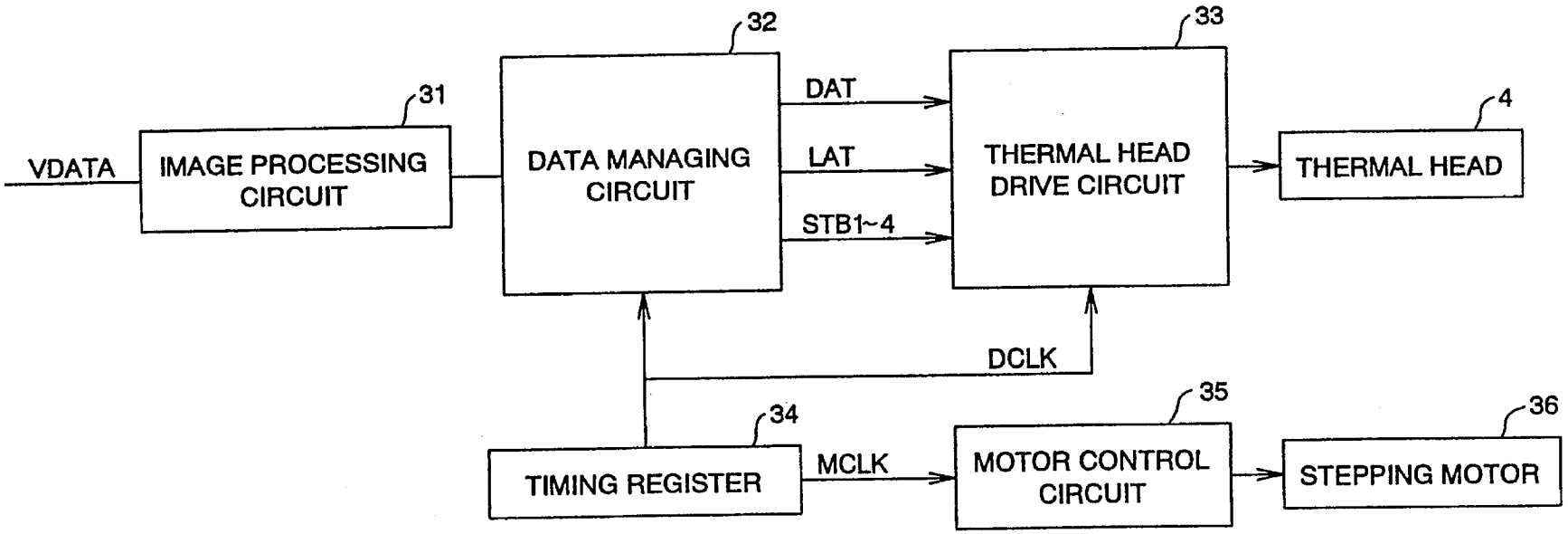
FIG. 9 is a block diagram of an embodiment of the control unit for the thermal recording device according to the present invention.
Figure 10:
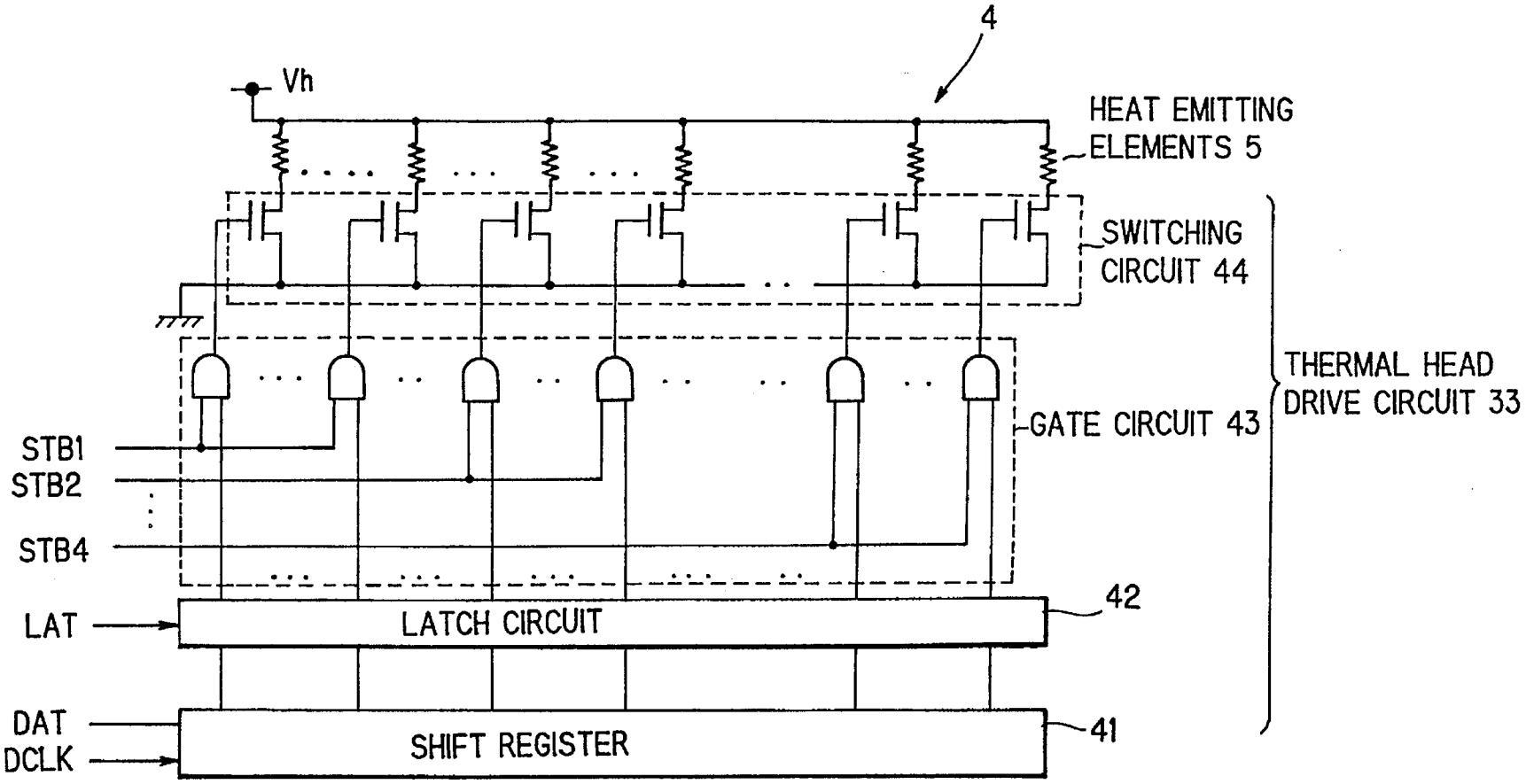
FIG. 10 is a circuit diagram showing the drive circuit for the heat emitting elements of the thermal head.
Figure 11:
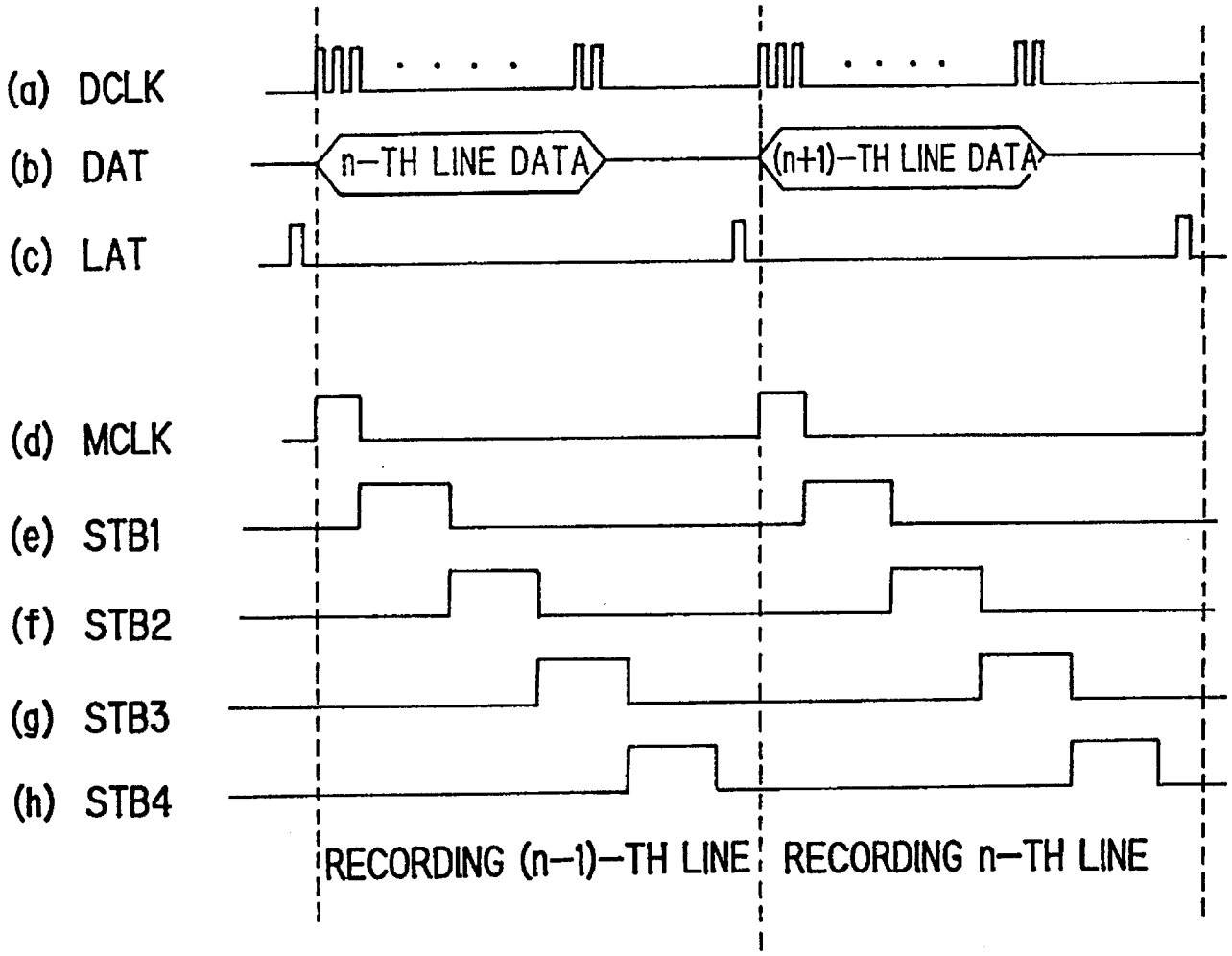
FIG. 11 is a timing chaff for illustrating the operation of the drive circuit for the heat emitting elements of the thermal head.
Figure 12:
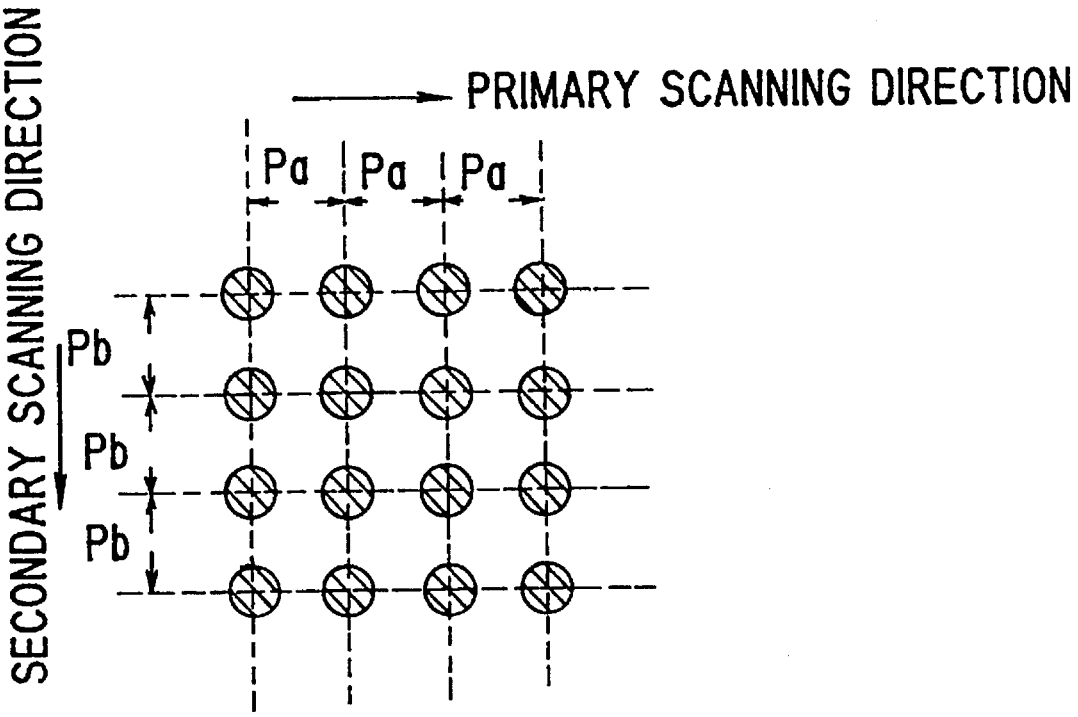
FIG. 12 is a diagram showing the arrangement of the perforations that will be produced in the thermal stencil sheet by the thermal recording device according to the present invention.

FIG. 9 is a block diagram for illustrating the control arrangement for forming an image on the thermal recording material 1. Image data (VDATA) read by an image sensor such as a CCD is fed to an image processing circuit 31 which carries out desired editing of the data, and assigning of desired attributes to the data. The data is then converted into a binary signal, and supplied to a data managing circuit 32. The data managing circuit 32 produces various signals required for driving a thermal head drive circuit 33 (which is illustrated in FIG. 10) in synchronism with a reference clock signal (DCLK) from a timing generator circuit 34. The timing generator circuit 34 also supplies synchronized drive pulses (MCLK) to a motor control circuit 35 to actuate the stepping motor 36 in a stepwise manner. The timing related to the operation of the data managing circuit 32 is illustrated in FIG. 11. The heat emitting elements 5 of the thermal head 4 are thus heated in synchronism with the operation of the stepping motor 36 regulated by the motor control circuit 35 to carry out the recording for each line of the recorded image.

FIG. 10 shows the thermal head drive circuit 33 in more detail. A shift register 41 stores recorded data (DAT) for a single line. The data is transferred to this shift register 41 as a serial signal in synchronism with the reference clock signal (DCLK), and the recorded data (DAT) stored in the shift register 41 and corresponding to a single line of the recorded image is supplied to a latch circuit 42 as a parallel signal. The latch circuit 42 stores the data (DAT) corresponding to a single line of the recorded image which is to be applied to the heat emitting elements 5, and receives the data from the shift register 41 in synchronism with the application of a latch signal (LAT) thereto. The recorded data (DAT) produced from this latch circuit 42 is supplied to gate circuits 43 as a parallel signal. One of a pair of inputs of each gate circuit 43 receives the signal for the recorded data (DAT) from the latch circuit 42, and the other input of the gate circuit 43 receives one of the strobe signals STB1 to STB4 for driving the thermal head 4 consisting of four segments in a time sharing arrangement. A switching circuit 44 consists of a plurality of switching devices provided in association with the heat emitting elements 5 and adapted to turn on and off according to the signal supplied from the gate circuit 43. Each of the switching devices which has turned on will supply electric power to the associated heat emitting element 5.

Therefore, when an associated strobe signal STB1 to STB4 is present, and the gate circuit 43 corresponding to the part of the latch circuit 42 storing the recorded data (black data) is turned on, the switching circuit 44 corresponding to this position is closed, and the corresponding heat emitting element 5 receives electric power. As a result, the heat emitting element 5 is heated, and a record or a dark dot is formed on the corresponding position of the thermal recording material 1.

The interval of the drive pulses (MCLK) for driving the stepping motor 36 in a stepwise manner is determined to be more than required for completing the recording of a single line of the image on the thermal recording material 1.

The action of recording a single line with the thermal head drive circuit 33 having the above described structure is now described in the following with reference to the time chart given in FIG. 11.

For example, the recorded data for the (n−1)-th line of the record is stored in the shift register 41, and a latch signal (LAT) is produced from the data managing circuit 32 (refer to FIG. 11(*c*)) so that the recorded data for the (n−1)-th line of the image stored in the shift register 41 is stored in the latch circuit 42.

Then, the stepping motor 36 is actuated by a single step by a stepping motor drive pulse (MCLK) from the timing generator circuit 34 supplied to the motor control circuit 35 (refer to FIG. 11(*d*)). As a result, the thermal recording material 1 is conveyed by prescribed length corresponding to a single line of the image. Thus, the thermal recording material 1 is conveyed by a distance corresponding to the dot pitch Pb in the secondary scanning direction of the dot matrix image which is to be recorded on the thermal recording material 1.

Upon completion of the conveying action of the thermal recording material 1, the strobe signals STB1 to STB4 are sequentially supplied according to a prescribed time sharing scheme (refer to FIGS. 11(*e*) to 11(*h*)), and the heat emitting elements 5 receive electric power and are heated according to the arrangement of the recorded data (DAT) so that a line of the image corresponding to the single line recorded data (DAT) is formed on the thermal recording material 1.

Then, the recorded data (DAT) for the n-th line is transferred to and stored in the shift register 41 in synchronism with the reference clock signal (DCLK) produced from the timing generator circuit 37. This process is repeated thereafter, and the recorded data of the n-th line is recorded on the thermal recording material 1. Upon completion of the recording of the n-th line of the image, the stepping motor 36 is actuated by an additional step, and the thermal recording material 1 is conveyed by a distance corresponding to the dot pitch Pb in the secondary scanning direction. This process is repeated until the entire desired image is recorded on the thermal recording material 1.

The dot pitch Pa of the dot matrix of the images formed on the recording surface 1*a* of the thermal recording material 1 in the primary scanning direction is determined by the pitch Pa of the heat emitting elements 5 in the primary scanning direction, and the dot pitch Pb of the dot matrix in the secondary scanning direction is determined by the heat emitting timing of the heat emitting elements 5 of the thermal head 4 in relation to the movement of the thermal recording material 1 in the secondary scanning direction.

In other words, the dot pitch Pb in the secondary scanning direction determined by the feed of the thermal recording material 1 corresponding to a single line of a recorded image and the timing of the heat emission of the heat emitting elements 5 of the thermal head 4 is dictated by the actual conveying speed of the thermal recording material 1 caused by the rotation of the platen roller 3 and the actual timing of energizing the heat emitting elements 5. In this conjunction, it is desirable to take into account the heat emitting response property of the heat emitting elements 5 or to directly evaluate the actual emission of heat from the heat emitting elements 5 to accurately control the manner in which an image is formed in the thermal recording material 1 typically by perforation.

In this case, the dot pitch of the dot matrix of the images formed on the recording surface 1*a* of the thermal recording material 1 in the primary scanning direction is determined by the pitch Pa of the heat emitting elements 5 in the primary scanning direction, and the dot pitch of the matrix in the secondary scanning direction is determined by the heat emitting response property of the heat emitting elements 5 of the thermal head 4 in relation with the moving speed of the thermal recording material in the secondary scanning direction. In the thermal recording device of the present invention, various parameters are so selected that the dot pitch of the dot matrix of the images formed by the heat from the heat emitting elements 5 of the thermal head 4 in the secondary scanning direction is made to be equal to the dot pitch in the primary scanning direction.

According to the present invention, to the end of achieving a balance of the image formed by a dot matrix, the dot pitch Pb in the secondary scanning direction is made equal to the dot pitch Pa in the primary scanning direction. Therefore, if the resolution of the thermal head 4 is 400 dots/inch, the dot pitches in the primary and secondary directions Pa and Pb are both made equal to 63.5 μm (Pa=Pb=63.5 μm). If the resolution of the thermal head 4 is 300 dots/inch, the dot pitches in the primary and secondary directions Pa and Pb would be made equal to 84.6 μm (Pa=Pb=84.6 μm). The outer diameter of the platen roller 3 and various parameters of the stepping motor 36 and the power transmission mechanism (not shown in the drawings) for transmitting the rotation of the stepping motor 36 to the platen roller 3 is determined in such a manner that the feed of the thermal recording material 1 by each rotative step of the stepping motor 36 is made equal to the dot pitch Pb in the secondary scanning direction.

If the lengths of each of the heat emitting elements 5 in the primary and secondary scanning directions are a and b, respectively, the thermal recording device of the present embodiment is characterized by the size of each of the heat emitting elements 5 being as follows:

$0.30\ Pa \leqq a \leqq 0.70\ Pa$, $0.60\ Pa \leqq b \leqq 0.95\ Pa$, and $Pa = Pb$.

Thus, as mentioned earlier, the dot pitch (secondary scanning pitch Pb) of the dot matrix of the images formed by the heat from the heat emitting elements 5 in the secondary scanning direction is equal to the dot pitch in the primary scanning direction which is equal to the pitch (primary scanning pitch) Pa of the heat emitting elements 5 in the primary scanning direction.

Therefore, when the lengths of each of the heat emitting elements 5 in the primary and secondary scanning directions are short as compared to the corresponding dot pitches, the region of heat generation of each of the heat emitting elements will not be affected by the heat from the adjacent heat emitting elements 5, and the recorded traces or, in the case of thermal recording paper, the colored dots, the perforated dots in the case of the thermal stencil master plate, and the frosted dots in the case of the OHP frost type TP sheet will be independent from each other both in the primary and secondary directions, leaving gaps of unrecorded regions between the recorded dots. The size of these dots depends on the size of the heat emitting elements, the sensitivity of the thermal recording material or the medium, the coloring properties in the case of the thermal recording paper, the perforation property of the thermo-plastic resin film in the case of the thermal stencil master plate, and the melting and transferring properties of the ink sheet onto the printing paper in the case of the transfer ribbon.

The gaps between the recorded dots are particularly useful for such thermal recording materials as thermal stencil master plate and thermal transfer ribbon which can rely on the seeping of ink, and the plate making or the printing by the device of the present invention can produce optimum gaps in the recording material.

Meanwhile, in the case of the thermal recording paper and the OHP coloring type TP sheets, the expansion of the colored parts corresponding to the seeping of ink cannot be expected as much as in the case of the thermal stencil master plate, but when characters (records) are printed by the device of the present invention, solid areas will be slightly light in gradation as compared to the characters (records) printed by the conventional thermal head (although the density of each colored dot may have reached a saturated density level, the gaps extending between the dots reduce the area of each dot in the high density regions). However, it is not visually discernible, and actually achieves some improvement in the reproducibility and legibility of small character images.

When the used device is such that the ratio of the length of each of the heat emitting elements 5 in the primary scanning direction to the scanning pitch in the primary scanning direction does not satisfy the conditions defined for the device of the present invention, in particular when the ratio is greater than that of the device of the present invention, the perforated dots are connected in both the secondary and primary scanning directions particularly under a high temperature condition, and unfavorable results such as the thickening and blurting of the lines of images and the ink transfer from one sheet of the printing paper to another tend to occur. If the ratio related to the dot pitch is smaller than that of the device of the present invention, the distance between adjacent perforated dots becomes excessive, and the thinning of picture images and lowering of gradation level in solid areas tend to occur.

Now, embodiments of the present invention and examples for comparison are now described in the following. The results of evaluating the embodiments and the examples for comparison are summarized in Tables 1 and 2.

EMBODIMENT 1

A thin film type thermal head of a 400 dots/inch (abbreviated as DPI hereinafter) resolution with the following specifications was mounted on a digital stencil master plate making and printing device (sold by Riso Kagaku Kogyo KK under the tradename of Risograph RC115D), and a thermal stencil master plate (tradename: RC Master 55) was processed by using an original containing character images and solid images. The ink used in this embodiment had a spread meter reading of one minute value of 33, and the printing device was the same as above (the same thing applies to the subsequent embodiments). The processing of the thermal recording paper (tradename: Riso thermal paper sheet type C-197) and OHP TP sheet (tradename: Riso TP film T-113) was also carried out with the single copy mode of the aforementioned device. The ambient temperature was 23° C.

Length of each heat emitting element in the primary scanning direction

→a=25 μm

Length of each heat emitting element in the second scanning direction

→b=60 μm

Dot pitch (primary and secondary scanning directions)

→Pa=Pb=63.5 μm

Heat emitting energy

→68.8–50.0 μJ/dot

The thermal stencil master plate was fabricated by laminating a polyester film (2 μm in thickness) and a porous support (9.5 g/m$^2$, manila hemp thin paper) with a bonding agent, and applying a release agent on the surface of the film facing the thermal head.

The thermal recording paper consisted of base paper carrying a layer of heat sensitive coloring agent with a density of 57 g/m$^2$.

The OHP TP film consisted of a polyester film (50 μm in thickness) provided with a layer of a coloring agent.

Figure 3:
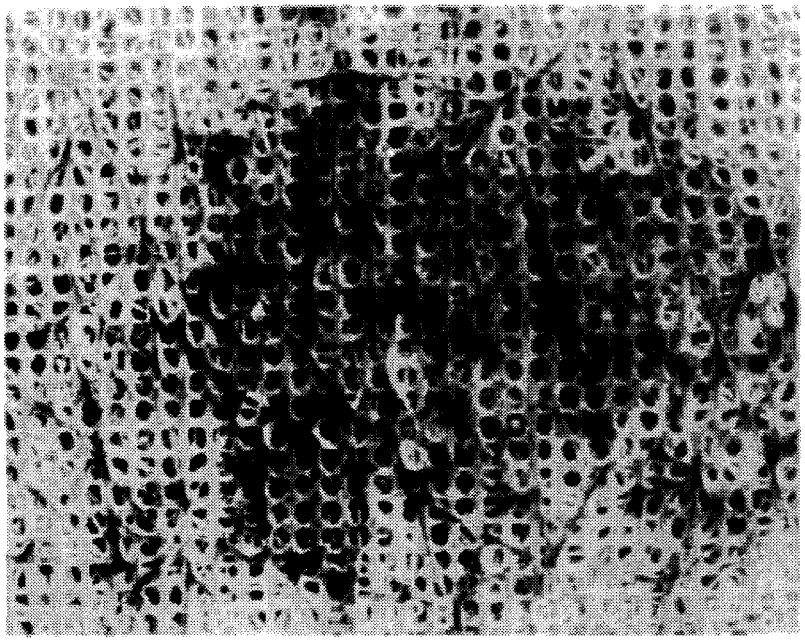
FIG. 3 is a microscopic photograph of a part of the thermal stencil master plate of the first embodiment obtained with a scanning electron microscope at a magnification factor of 100.
Figure 4:
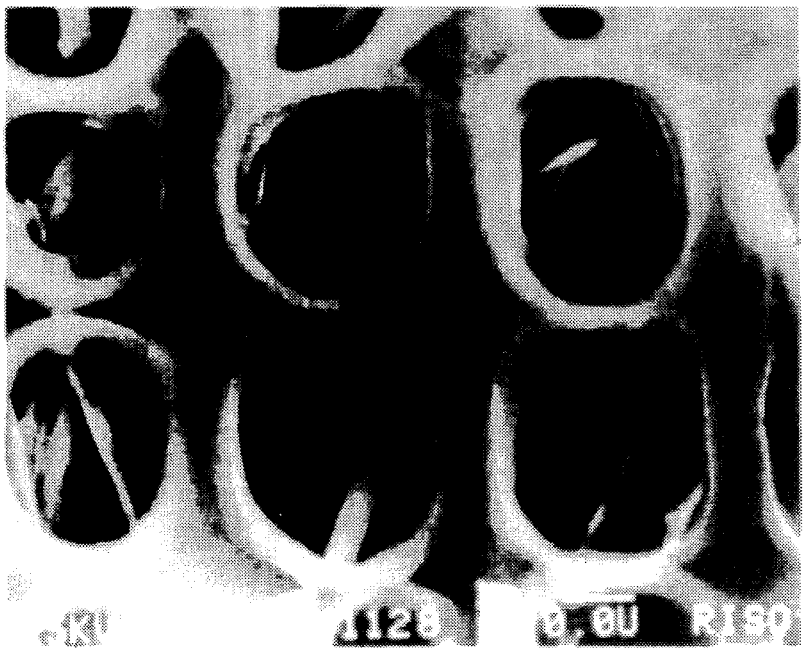
FIG. 4 is an enlarged view of a part of FIG. 3 at a magnification factor of 1000.

As indicated by the microscopic photographs in FIGS. 3 and 4, the perforated dots which formed solid parts of the picture image were independent from each other, and formed a uniform dot matrix so that the unprocessed gaps between the adjacent dots may extend in both the primary and secondary scanning directions uniformly in the manner of a grid.

When the quality of the character image on the thermal recording paper and the picture image formed on the OHP TP sheet were evaluated by using a microscope, it was found that the unprocessed gaps existed between colored dots, but they were visually indiscernible enough for the solid parts to be regarded as such. In regards to character images consisting of fine lines, they were also faithfully reproduced from the original. The projected images of the processed TP sheet were also quite satisfactory.

When prints were made by using such a processed thermal stencil master plate, the parts corresponding to the unprocessed gaps between perforated dots observed in the master plate were filled by the seeping of the ink, and the printed solid parts were quite favorable. In regards to character images also, printed images faithful to the original were obtained without involving any thinning, thickening or blurring. In particular, favorable reproduction of minute character images was achieved. The images were comparable to those obtained by using thermal recording paper.

A prescribed number of prints were made by operating the aforementioned recording device at the rate of 60 to 130 sheets per minute, and the reverse surface of each of the printed sheets piled into a stack showed substantially no smearing by ink or no ink transfer.

The durability of the master plate was found to be favorable.

EMBODIMENT 2

The same operation as that of the first embodiment was carried out at the ambient temperature of 10° C.

The perforated dots of the thermal stencil master plate and the colored dots of the thermal recording paper and the OHP TP sheet had a tendency to be slightly smaller than those of the first embodiment, but a required picture quality was ensured in each case without creating any problem.

EMBODIMENT 3

The same operation as that of the first embodiment was carried out at the ambient temperature of 35° C.

The perforated dots of the thermal stencil master plate and the colored dots of the thermal recording paper and the OHP TP sheet had a tendency to be slightly larger than those of the first embodiment, but a required picture quality was ensured in each case without creating any problem.

EMBODIMENT 4

The recordability of the thermal recording materials (thermal stencil master plate, thermal recording paper and OHP TP sheet) was investigated by using a thin film type thermal head of 400 DPI which was set up as described above and the same device and original as the first embodiment. The ambient temperature was 23° C.

Length of each heat emitting element in the primary scanning direction

→a=35 μm

Length of each heat emitting element in the second scanning direction

→b=60 μm

Dot pitch (primary and secondary scanning directions)

→Pa=Pb=63.5 μm

Heat emitting energy

→75.0–55.0 μJ/dot

Figure 5:
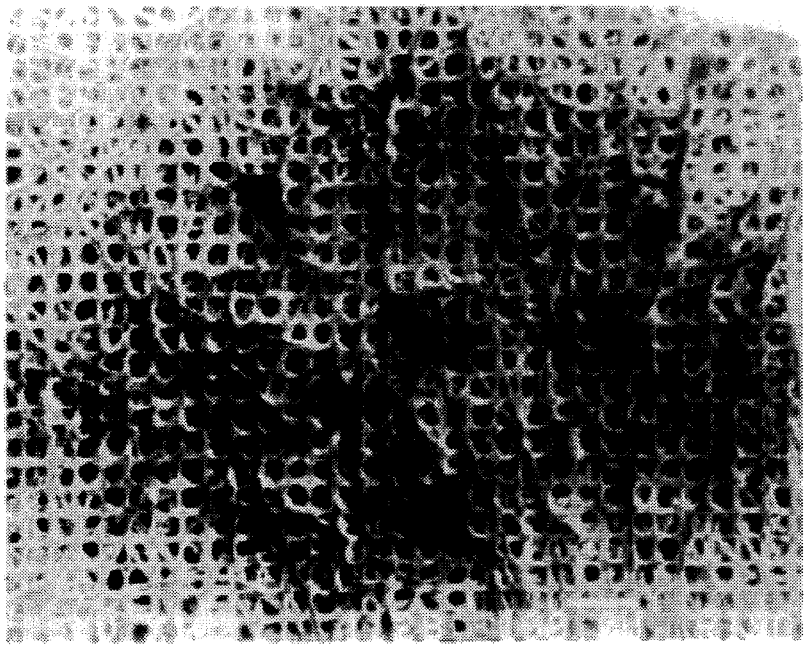
FIG. 5 is a microscopic photograph of a part of the thermal stencil master plate of the fourth embodiment obtained with a scanning electron microscope at a magnification factor of 10.
Figure 6:
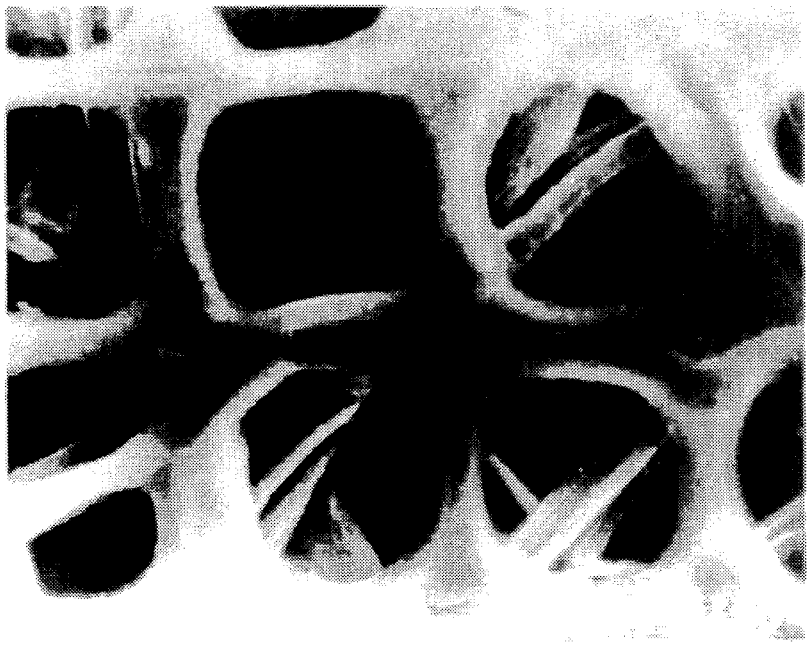
FIG. 6 is an enlarged view of a part of FIG. 5 at a magnification factor of 100.

When a pan of the thermal stencil master plate obtained in this embodiment was observed with a scanning electron microscope, the condition of the plate in the solid regions was found to be favorable as shown in the microscopic photographs of FIGS. 5 and 6. In other words, the perforated dots forming the solid areas were independent from each other, and formed a uniform dot matrix by defining unprocessed gaps between consecutive dots in both the primary and secondary directions in the manner of a grid.

When the quality of the character images on the thermal recording paper and the picture image formed on the OHP TP sheet was evaluated by using a microscope, it was found that the unprocessed gaps existed between colored dots in the solid regions, but they were visually indiscernible enough for the solid parts to be regarded as such in regards to both solid images and character images.

When prints were made by using a processed thermal stencil master plate, the parts corresponding to the unprocessed gaps between perforated dots observed in the master plate were filled by the seeping of the ink, and the printed solid parts were quite favorable. In regards to character images also, printed images faithful to the original were obtained without involving any thinning, thickening or blurring. In particular, favorable reproduction of minute character images was achieved. The images were comparable to those obtained by using thermal recording paper.

A prescribed number of prints were made by operating the aforementioned recording device at the rate of 60 to 130 sheets per minute, and the reverse surface of each of the printed sheets piled into a stack showed substantially no smearing by ink.

The durability of the master plate was found to be satisfactory.

EMBODIMENT 5

The same operation as that of the fourth embodiment was carried out at the ambient temperature of 10° C.

The perforated dots of the thermal stencil master plate and the colored dots of the thermal recording paper and the OHP TP sheet had a tendency to be slightly smaller than those of the fourth embodiment, but a required picture quality was ensured in each case without creating any problem.

EMBODIMENT 6

The same operation as that of the fourth embodiment was carried out at the ambient temperature of 35° C.

The perforated dots of the thermal stencil master plate and the colored dots of the thermal recording paper and the OHP TP sheet had a tendency to be slightly larger than those of the fourth embodiment, but a required picture quality was ensured in each case without creating any problem.

EMBODIMENT 7

The recordability of the thermal recording materials (thermal stencil master plate, thermal recording paper and OHP TP sheet) was investigated by using a thin film type thermal head of 400 DPI which was set up as described above and the same device and original as the first embodiment. The ambient temperature was 23° C.

Length of each heat emitting element in the primary scanning direction

→a=44 μm

Length of each heat emitting element in the second scanning direction

→b=60 μm

Dot pitch (primary and secondary scanning directions)

→Pa=Pb=63.5 μm

Heat emitting energy

→81.5–60.0 μJ/dot

In this case, the perforated dots forming the solid areas were independent from each other, and formed a uniform dot matrix by defining unprocessed gaps between consecutive dots in both the primary and secondary directions in the manner of a grid.

When the quality of the character images on the thermal recording paper and the picture image formed on the OHP TP sheet was evaluated by using a microscope, it was found that the unprocessed gaps existed between colored dots in the solid regions, but they were visually indiscernible enough for the solid parts to be regarded as such in regards to both solid images and character images.

When prints were made by using a processed thermal stencil master plate, the parts corresponding to the unprocessed gaps between perforated dots observed in the master plate were filled by the seeping of the ink, and the print quality of the solid parts was quite favorable. In regards to character images also, printed images faithful to the original were obtained without involving any thinning, thickening or blurring. There was no smearing of the reverse surface of the printing paper.

EMBODIMENT 8

The same operation as that of the seventh embodiment was carried out at the ambient temperature of 10° C.

The perforated dots of the thermal stencil master plate and the colored dots of the thermal recording paper and the OHP TP sheet had a tendency to be slightly smaller than those of the seventh embodiment, but a required picture quality was ensured in each case without creating any problem.

EMBODIMENT 9

The same operation as that of the seventh embodiment was carried out at the ambient temperature of 35° C.

The perforated dots of the thermal stencil master plate and the colored dots of the thermal recording paper and the OHP TP sheet had a tendency to be slightly larger than those of the seventh embodiment, but a required picture quality was ensured in each case without creating any problem.

EXAMPLE 1 FOR COMPARISON

The recordability of the thermal recording materials (thermal stencil master plate, thermal recording paper and OHP TP sheet) was investigated by using a thin film type thermal head of 400 DPI which was set up as specified below and the same device and original as the first embodiment for the purpose of comparing it to those of the embodiments 1 through 9. The ambient temperature was 23° C.

Length of each heat emitting element in the primary scanning direction

→a=53 μm

Length of each heat emitting element in the second scanning direction

→b=60 μm

Dot pitch (primary and secondary scanning directions)

→Pa=Pb=63.5 μm

Heat emitting energy

→87.5–65.0 μJ/dot

Figure 7:
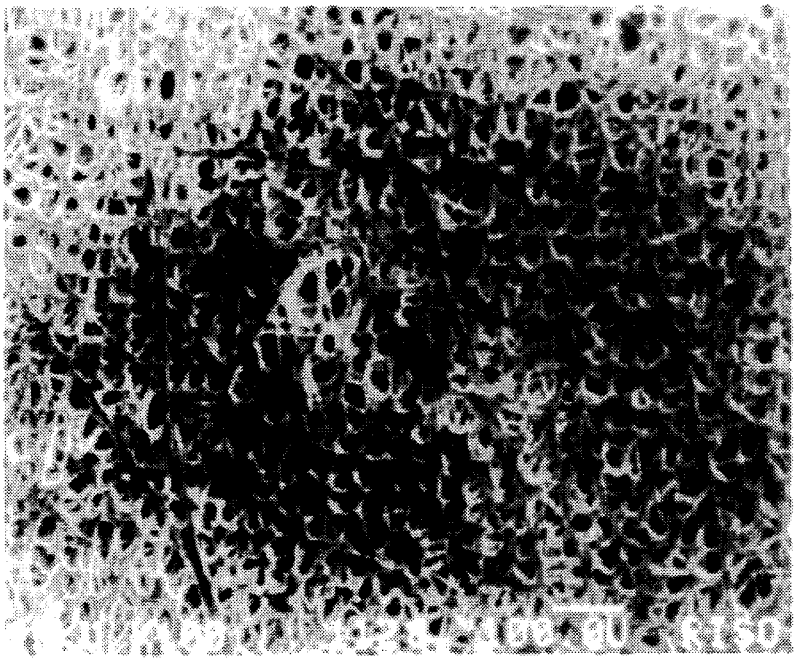
FIG. 7 is a microscopic photograph of a part of the thermal stencil master plate of the first example for comparison obtained with a scanning electron microscope at a magnification factor of 10.
Figure 8:
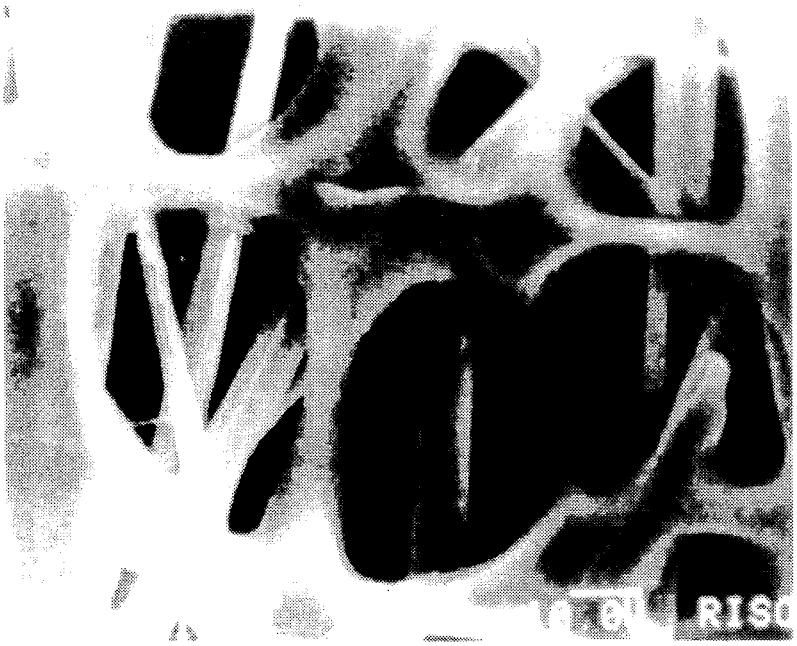
FIG. 8 is an enlarged view of a part of FIG. 7 at a magnification factor of 100.

As shown in the microscopic photographs of FIGS. 7 and 8 taken with a scanning electron microscope and showing a solid picture image formed in a thermal stencil master plate, the perforated dots forming the solid areas were expanded in the primary or secondary scanning direction, and are merged with the adjacent ones, demonstrating the thermal influences from adjacent heat emitting elements. Therefore, the unprocessed gaps between consecutive dots were extremely small in some areas as compared to the above described embodiments, and the perforated dot matrix forming the solid regions was found to be inferior in terms of uniformity as compared with the above described embodiments.

When prints were made by using a processed thermal stencil master plate, the character images involved substantial thickening and blurring, and the solid areas contained a substantial amount of imprints of the fibrous support. This was caused by the pails of the film corresponding to those dots which were thermally affected by adjacent heat emitting elements and excessively melted, and the fluidized film which entangled with the fibers of the porous support and formed resolidified film or lumps. Further, the perforated dots became uneven in size, and the height of the ink deposited on the printing paper became uneven thereby causing unevenness in the density of the picture image.

There was a substantial amount of ink transfer because the expansion and blurring of the perforated dots became excessive, and the amount of ink deposition was accordingly great, thereby slowing the process of drying the printing ink.

As for the printing durability, the unprocessed gaps between the perforated dots are less than those of the embodiments, and the mechanical strength of the film was diminished, thus producing generally less favorable results than those of the above mentioned embodiments.

As for the coloring performances of the thermal recording paper and the OHP TP sheet, the colored dots forming solid regions were continuous, and a sufficient density was obtained. However, small character images involved thickening and blurring of lines, and legibility was diminished as compared to the above described embodiments.

EXAMPLE 2 FOR COMPARISON

The same operation as the first example for comparison was carried out at the ambient temperature of 10° C.

The extent to which the perforated dots of the thermal stencil master plate and the colored dots of the thermal recording paper and the OHP TP sheet expanded and merged with the adjacent ones was eased as compared to the first example, and the thickening and merging of the lines in the character images was reduced. However, the sensitivity of the perforation and coloring was reduced as compared to that of the first example, and generation of unperforated dots and reduction in the area of each colored dot caused whitening or reduction in the density of solid areas.

EXAMPLE 3 FOR COMPARISON

The same operation as the first example for comparison was carried out at the ambient temperature of 35° C.

The extent to which the perforated dots of the thermal stencil master plate and the colored dots of the thermal recording paper and the OHP TP sheet expanded and merged with the adjacent ones became even worse as compared to the first example, and the thickening and merging of the lines in the character images was more pronounced, resulting in a poor picture quality. In particular, the perforated dots forming solid images became more random in terms of size, shape and arrangement. It was presumably because each of the perforated dots was affected by the heat front adjacent heat emitting elements. The condition of perforation did not reflect the resolution of the thermal head (400 DPI) at all, and the prints produced by the processed master plate involved excessive ink transfer.

EXAMPLE 4 FOR COMPARISON

The recordability of the thermal recording materials (thermal stencil master plate, thermal recording paper and OHP TP sheet) was investigated by using a thin film type thermal head of 400 DPI which was set up as specified below and the same device and original as the first embodiment. The ambient temperature was 23° C.

Length of each heat emitting element in the primary scanning direction

→a=44 μm

Length of each heat emitting element in the second scanning direction

→b=85 μm

Dot pitch (primary and secondary scanning directions)

→Pa=Pb=63.5 μm

Heat emitting energy

→100.0–75.0 μJ/dot

In regards to the coloring and recordability of the thermal recording paper or the OHP TP sheet, the density of the coloring in the solid areas was sufficiently high, and a microscopic observation revealed some continuity in the colored dots. The picture images were generally favorable except for some thickening and merging of the lines of small characters.

However, the perforations in the thermal stencil master plate were continuous in both the primary and secondary scanning directions, and the picture images contained more imprints of the fibrous support than the first example for comparison with the added disadvantages of more severe ink transfer and increased ink consumption.

EXAMPLE 5 FOR COMPARISON

The same operation as the fourth example for comparison was carried out at the ambient temperature of 10° C.

The perforations of the thermal stencil master plate were continuous in both the primary and secondary scanning directions in some areas, but there were also areas where perforations were not produced (due to insufficient sensitivity). The prints contained excessive unevenness in density.

The character images of the OHP TP film involved thinning (breaks in fine lines) due to the insufficiency in sensitivity.

EXAMPLE 6 FOR COMPARISON

The same operation as the fourth example for comparison was carried out at the ambient temperature of 35° C.

A majority of the perforated dots of the thermal stencil master plate were continuous in both the primary and secondary scanning directions, and the printability was extremely poor with severe thickening of character images and ink transfer.

In regards to the thermal recording paper and the OHP TP sheet, the density of solid areas was favorably high, but excessive merging and thickening of the lines of the character images prevented reproduction of clear images.

The results of evaluating the above described embodiments and examples for comparison are given in Tables 1 and 2.

TABLE 1

| Embodiments | Size of heat emitting element a: primary b: secondary | dot pitch | area ratio of heat emitting element to dot pitch | ambient temp. |
|---|---|---|---|---|
| #1 | a = 25 μm<br>b = 60 μm | 63.5 μm above | primary 39.4%<br>secondary 94.5% | 23° C. |
| #2 | same as above | same as above | same as above | 10° C. |
| #3 | same as above | same as above | same as above | 35° C. |
| #4 | a = 35 μm<br>b = 60 μm | same as above | primary 55.1%<br>secondary 94.5% | 23° C. |
| #5 | same as above | same as above | same as above | 10° C. |
| #6 | same as above | same as above | same as above | 35° C. |
| #7 | a = 44 μm<br>b = 60 μm | same as above | primary 69.3%<br>secondary 94.5% | 23° C. |
| #8 | same as above | same as above | same as above | 10° C. |
| #9 | same as above | same as above | same as above | 35° C. |

| | Recordability of thermal recording materials | | | | | | | | |
|---|---|---|---|---|---|---|---|---|---|
| | | | | | | thermal recording paper | | OHP TP film | |
| | Thermal stencil master plate | | | | | coloring | character | coloring | character |
| Embodiments | perforation | print quality | offsetting | durability | ink consumption | of solid region | reprodicibility | of solid region | reprodicibility |
| #1 | OO | OO | OO | OO | OO | O | OO | O | OO |
| #2 | OO | OO | OO | OO | OO | O | OO | O | OO |
| #3 | OO | OO | OO | OO | OO | O | OO | O | OO |
| #4 | OO | OO | OO | OO | OO | O | OO | O | OO |
| #5 | OO | OO | OO | OO | OO | O | OO | O | OO |
| #6 | OO | OO | OO | OO | OO | OO | OO | OO | OO |
| #7 | OO | OO | OO | OO | OO | OO | O | OO | O |
| #8 | OO | OO | OO | OO | OO | OO | OO | OO | OO |
| #9 | O | O | O | O | O | OO | O | OO | O |

TABLE 2

| Examples for Comparison | Size of heat emitting element a: primary b: secondary | dot pitch | area ratio of heat emitting element to dot pitch | ambient temp. |
|---|---|---|---|---|
| #1 | a = 53 μm<br>b = 60 μm | same as above | primary 83.5%<br>secondary 94.5% | 23° C. |

TABLE 2-continued

| | | | | |
|---|---|---|---|---|
| #2 | same as above | same as above | same as above | 10° C. |
| #3 | same as above | same as above | same as above | 35° C. |
| #4 | a = 44 μm<br>b = 85 μm | same as above | primary 69.3%<br>secondary 133.9% | 23° C. |
| #5 | same as above | same as above | same as above | 10° C. |
| #6 | same as above | same as above | same as above | 35° C. |

| | Recordability of thermal recording materials | | | | | | | | |
|---|---|---|---|---|---|---|---|---|---|
| | | | | | | thermal recording paper | | OHP TP film | |
| | Thermal stencil master plate | | | | | coloring | character | coloring | character |
| Examples for Comparison | perforation | print quality | offsetting | durability | ink consumption | of solid region | reprodicibility | of solid region | reprodicibility |
| #1 | Δ | Δ thinning | Δ | O | Δ | OO | O | OO | Δ merging |
| #2 | O | Δ thinning | O | OO | O | O | Δ thinning | O | Δ merging |
| #3 | X | X | XX | Δ | X | OO | X thickening | OO | X thickening |
| #4 | X | X thickening | X | Δ | X | OO | Δ merging | OO | Δ merging |
| #5 | Δ | X unevenes | Δ | O | Δ | OO | O | OO | Δ thinning |
| #6 | XX | XX thickening | XX | X | XX | OO | X thickening | OO | X thickening |

In Tables 1 and 2, "OO" denotes "very good", "O" denotes good, "Δ" denotes fair, "X" denotes poor, and "XX denotes "very poor". The criteria for each item of evaluation are as given in the following:

1. Evaluation of the thermal stencil master plate

1) Condition of the perforation

OO—The perforation dots are independent from each other and define a uniform dot matrix.

O—The arrangement of the perforation dots is uneven, but are independent from each other.

Δ—The perforation dots are partly continuous.

X—A substantial part of the perforation dots are continuous.

XX—Expansion and merging of the perforation dots are severe.

2) Condition of the prints

OO—The uniformity of solid areas and the reproducibility of character images are both favorable.

O—The quality is generally acceptable, but the lines of character images are partly thickened.

Δ—Thinning or merging of the lines of character images can be seen.

X—Thickening of images is conspicuous.

XX—Thickening of images is severe, and the images are blurred as a whole.

3) Ink transfer

OO—There is almost no ink transfer.

O—There is a slight ink transfer.

Δ—The solid areas give rise to ink transfer.

X—There is a significant ink transfer.

XX—There is a severe ink transfer.

4) Plate durability

OO—More than 5,000 prints.

O—About 5,000 prints.

Δ—About 4,000 prints.

X—Less than 4,000 prints.

5) Ink consumption (The number of prints of B4 paper with an image ratio of 20% that can be made with 1,000 cc of printing ink)

OO—More than 10,000 prints.

O—More than 9,000 prints.

Δ—More than 8,000 prints.

X—More than 7,000 prints

XX—Less than 7,000 prints.

2. Evaluation of the thermal printing paper

1) Coloring of solid areas

OO—Particularly favorable with a sufficient density.

O—Solid areas are in a favorable condition.

2) Reproducibility of character images

OO—Legibility of even the small characters is favorable.

O—There are some merging of lines in parts of the small characters

Δ—There are thinning or merging of lines, and the images lack evenness.

X—There are conspicuous merging and thickening of the lines of the character images.

3. Evaluation of the OHP TP sheet

The same as the thermal recording paper.

Since the ratios of the lengths of each heat emitting element in the primary and secondary scanning directions are 30 to 70% and 60 to 95%, respectively, to the dot pitches in the corresponding directions in the thermal plate making device of the present invention, faithful reproduction is possible for all kinds of images including small character images and solid images, and one can obtain other advantages such as a favorable ink transfer prohibiting properly, a high plate durability, a favorable print capability with controlled ink consumption, and an expanded environmental adaptability which can cover a wide temperature range.

Further, the thermal recording device is suitable for use with thermal recording paper and OHP TP sheets, and is particularly advantageous in reproducing minute character images.

Although the present invention has been described in terms of preferred embodiments thereof, it is obvious to a person skilled in the art that various alterations and modifications are possible without departing from the scope of the present invention which is set forth in the appended claims.

What we claim is:

1. A thermal recording device for forming an image with a dot matrix, comprising:

a thermal recording material;

a thermal head, including a plurality of heat emitting elements arranged in a single row at a first itch along a primary scanning direction;

thermal head applying means for applying said thermal head onto a surface of said thermal recording material in said primary scanning direction;

thermal recording material moving means for moving said thermal recording material relative to said thermal head in a secondary scanning direction perpendicular to said primary scanning direction; and heating means for selectively heating said heat emitting elements in synchronism with a movement of said thermal recording material at second pitch in said secondary scanning direction; wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch to 60 to 95%, and wherein, a dot matrix pitch of an image formed on said thermal recording material is determined in said primary scanning direction by said first pitch of said heat emitting elements and in said secondary direction by a heat emitting timing of said heat emitting elements relative to a movement of said thermal recording material in said secondary scanning direction.

2. A thermal recording device according to claim 1, wherein said first pitch is substantially equal to said second pitch.

3. A thermal recording device according to claim 1, wherein said thermal recording material comprises a thermal stencil master plate.

4. A thermal recording device according to claim 1, wherein said thermal recording material comprises heat sensitive paper.

5. A thermal recording device according to claim 1, wherein said thermal recording material comprises thermal transfer ribbon.

6. A thermal recording device according to claim 1, wherein said thermal head applying means comprises a platen roller, and said thermal recording material moving means comprises a motor for rotatively driving said platen roller.

7. A thermal recording device for forming an image with a dot matrix, comprising:

a thermal recording material;

a thermal head, including a plurality of heat emitting elements arranged in a single row at a first pitch along a primary scanning direction;

thermal head applying means for applying said thermal head onto a surface of said thermal recording material in said primary scanning direction;

thermal recording material moving means for moving said thermal recording material relative to said thermal head in a second scanning direction perpendicular to said primary scanning direction; and heating means for selectively heating said heat emitting elements in synchronism with a movement of said thermal recording material at second pitch in said secondary scanning direction, wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch is 60 to 95%, and wherein, a dot matrix pitch of an image formed on said thermal recording material is determined in said primary scanning direction by said first pitch of said heat emitting elements and in said secondary scanning direction by controlling heat emission of said heat emitting elements in relation to a movement of said thermal recording material in said secondary scanning direction.

8. A thermal recording device according to claim 7, wherein said first pitch is substantially equal to said second pitch.

9. A thermal recording device according to claim 7, wherein said thermal recording material comprises a thermal stencil master plate.

10. A thermal recording device according to claim 7, wherein said thermal recording material comprises heat sensitive paper.

11. A thermal recording device according to claim 7, wherein said thermal recording material comprises thermal transfer ribbon.

12. A thermal recording device according to claim 7, wherein said thermal head applying means comprises a platen roller, and said thermal recording material moving means comprises a motor for rotatively driving said platen roller.

13. A thermal recording device for forming an image with a dot matrix, comprising:

a thermal recording material;

a thermal head, including a plurality of heat emitting elements arranged in a single row at a first pitch along a primary scanning direction;

thermal head applying means for applying said thermal head onto a surface of said thermal recording material in said primary scanning direction;

thermal recording material moving means for moving said thermal recording material relative to said thermal head in a secondary scanning direction perpendicular to said primary scanning direction; and heating means for selectively heating said heat emitting elements in synchronism with a movement of said thermal recording material at second pitch in said secondary scanning direction, wherein, a ratio of a first length of each of said heat emitting elements of said thermal head in said primary scanning direction of said first pitch is 30 to 70%, and a ratio of a second length of each of said heat emitting elements of said thermal head in said secondary scanning direction to said second pitch is 60 to 95% and wherein, a dot matrix pitch of an image formed on said thermal recording material is determined in said primary scanning direction by said first pitch of said heat emitting elements and in said second scanning direction according to a heat emitting response property of said heat emitting elements in relation to a moving speed of said thermal recording material in said secondary scanning direction.

14. A thermal recording device according to claim 13, wherein said first pitch is substantially equal to said second pitch.

15. A thermal recording device according to claim 13, wherein said thermal recording material comprises a thermal stencil master plate.

16. A thermal recording device according to claim 13, wherein said thermal recording material comprises heat sensitive paper.

17. A thermal recording device according to claim 13, wherein said thermal recording material comprises thermal transfer ribbon.

18. A thermal recording device according to claim 13, wherein said thermal head applying means comprises a platen roller, and said thermal recording material moving means comprises a motor for rotatively driving said platen roller.

19. A method for forming a dot matrix image on a thermal recording material comprising the steps of:

applying a thermal head along a primary scanning direction onto a surface of said thermal recording material;

moving said thermal recording material relative to said thermal head in a secondary scanning direction; and selectively heating a plurality of heat elements arranged in a single row at a first pitch along said primary scanning direction by heating said heat emitting elements at an appropriate timing in relation to a movement of said thermal recording material at a second pitch in said secondary scanning direction; wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch is 60 to 95% and wherein, a dot matrix pitch of an image formed on said thermal recording material is determined in said primary scanning direction by said first pitch of said heat emitting elements and in said secondary scanning direction by a heat emitting timing of said heat emitting elements relative to a movement of said thermal recording material in said secondary scanning direction.

20. A method for forming a dot matrix image on a thermal recording material comprising the steps of:

applying a thermal head along a primary scanning direction onto a surface of said thermal recording material;

moving said thermal recording material relative to said thermal head in a secondary scanning direction; and selectively heating a plurality of heat emitting elements arranged in a single row at a first pitch along said primary scanning direction by heating said heat emitting elements at an appropriate timing in relation to a movement of said thermal recording material at a second pitch in said secondary scanning direction; wherein, a ratio of a first length of each of said heat emitting elements of said thermal head in said primary scanning direction to said first pitch is 30 to 70%, and a ratio of a second length of each of said heat emitting elements of said thermal head in aid secondary scanning direction to said second pitch is 60 to 95%, and wherein, a dot matrix pitch of an image formed on said thermal recording material is determined in said primary scanning direction by said first pitch of said heat emitting elements and in said secondary scanning direction by controlling heat emission of said heat emitting elements in relation to a movement of said thermal recording material in said secondary scanning direction.

21. A method for forming a dot matrix image on a thermal recording material comprising the steps of:

applying a thermal head along a primary scanning direction onto a surface of said thermal recording material;

moving said thermal recording material relative to said thermal head in a secondary scanning direction; and selectively heating a plurality of heat emitting elements arranged in a single row at a first pitch along said primary scanning direction by heating said heat emitting elements at an appropriate timing in relation to a movement of said thermal recording material at a second pitch in said secondary scanning direction; wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch is 60 to 95%, and wherein, a dot matrix pitch of an image formed on said thermal recording material is determined in said primary scanning direction by said first pitch of said heat emitting elements and said secondary scanning direction according to a heat emitting response property of said heat emitting elements in relation to a moving speed of said thermal recording material in said secondary scanning direction.

22. A thermal recording device for forming an image with a dot matrix, comprising:

a thermal recording material;

a thermal head, including a plurality of heat emitting elements arranged in a single row at a first pitch along a primary scanning direction;

thermal head applying means for applying said thermal head onto a surface of said thermal recording material in said primary scanning direction;

thermal recording material moving means for moving said thermal recording material relative to said thermal head in a secondary scanning direction perpendicular to said primary scanning direction; and heating means for selectively heating said heat emitting elements in synchronism with a movement of said thermal recording material at second pitch in said secondary scanning direction, wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch is 60 to 95%, and wherein, a dot matrix pitch of an image formed on said thermal recording materials is determined in said primary scanning direction by said first pitch of said heat emitting elements and in said secondary scanning direction by a heat emitting timing of said heat emitting elements relative to a moving speed of a said thermal recording material in said secondary scanning direction.

23. A method for forming a dot matrix image on a thermal recording material comprising the steps of:

applying a thermal head along a primary scanning direction onto a surface of said thermal recording material;

moving said thermal recording material relative to said thermal head in a secondary scanning direction; and selectively heating a plurality of heat emitting elements arranged in a single row at a first pitch along said primary scanning direction by heating said heat emitting elements at an appropriate timing in relation to a movement of said thermal recording material at a second pitch in said secondary scanning direction; wherein, a ratio of a first length of each of said heat emitting elements of said thermal head in said primary scanning direction to said first pitch is 30 to 70%, and a ratio of a second length of each of said heat emitting elements of said thermal head in said secondary scanning direction to said second pitch is 60 to 95%, and wherein, a dot matrix pitch of an image formed on said thermal recording material is determined in said primary scanning direction by said first pitch of said heat emitting elements and in said secondary scanning direction by a heat emitting timing of said heat emitting elements relative to a moving speed of said thermal recording material in said secondary scanning direction.

* * * * *